US005610640A

United States Patent [19]

Anderson et al.

[11] Patent Number: 5,610,640

[45] Date of Patent: Mar. 11, 1997

[54] MAINTENANCE APPARATUS USING TRANSLATION FORCES TO MOVE CAP MEMBER FOR INK JET PRINTHEADS

[75] Inventors: David G. Anderson; Alfred J. Claflin, both of Ontario, N.Y.

[73] Assignee: Xerox Corporation, Stamford, Conn.

[21] Appl. No.: 386,783

[22] Filed: Feb. 10, 1995

[51] Int. Cl.[6] ..... B41J 2/165

[52] U.S. Cl. ..... 347/32; 347/30; 347/33; 347/42

[58] Field of Search ..... 347/22, 23, 29, 347/30, 32, 92, 33

[56] References Cited

U.S. PATENT DOCUMENTS

| | | | |
|---|---|---|---|
| 5,040,000 | 8/1991 | Yokoi | 347/30 |
| 5,206,666 | 4/1993 | Watanabe et al. | 347/32 X |
| 5,210,550 | 5/1993 | Fisher et al. | 347/30 |
| 5,250,962 | 10/1993 | Fisher et al. | 347/32 |
| 5,257,044 | 10/1993 | Carlotta et al. | 347/32 |
| 5,367,326 | 11/1994 | Pond et al. | 347/22 |
| 5,432,539 | 7/1995 | Anderson | 347/33 |

*Primary Examiner*—John E. Barlow, Jr.
*Attorney, Agent, or Firm*—Daniel J. Krieger

[57] ABSTRACT

A maintenance apparatus for maintaining an ink jet printhead. The maintenance apparatus includes a maintenance station having a first member, a translation apparatus connected to the maintenance station which generates a translation force to translate the maintenance station along a path, and a displacement apparatus connected to the translation apparatus and operatively coupled to the first member for displacing the first member with respect to the translation apparatus. The maintenance apparatus minimizes system complexity by using the energy which translates the maintenance station for extending and retracting the capping member which seals the area around the front nozzle face of an ink jet printhead during periods of non-use. A lead screw and a motor move the maintenance station in a direction towards an ink jet printhead for maintenance operations and a actuating lever and camming system move the capping member into contact with the front face of the ink jet printhead.

12 Claims, 4 Drawing Sheets

MAINTENANCE APPARATUS USING TRANSLATION FORCES TO MOVE CAP MEMBER FOR INK JET PRINTHEADS

FIELD OF THE INVENTION

This invention relates generally to maintaining the nozzles of an ink jet printhead and more particularly to an apparatus for moving a maintenance station to an ink jet printhead for maintenance thereof.

BACKGROUND OF THE INVENTION

An ink jet printer of the type frequently referred to as drop-on-demand, has at least one printhead from which droplets of ink are directed towards a recording medium. Within the printhead, the ink is contained in a plurality of channels. Piezoelectric devices or power pulses cause the droplets of ink to be expelled as required, from orifices or nozzles located at the end of the channels. In thermal ink jet printing, the power pulses are usually produced by resistors also known as heaters, each located in a respective one of the channels. The heaters are individually addressable to heat and vaporize the ink in the channels. As a voltage is applied across a selected heater, a vapor bubble grows in that particular channel and ink bulges from the channel nozzle. At that stage, the bubble begins to collapse. The ink within the channel retracts and then separates from the bulging ink thereby forming a droplet moving in a direction away from the channel nozzle and towards the recording medium whereupon hitting the recording medium a spot is formed. The channel is then refilled by capillary action which, in turn, draws ink from a supply container of liquid ink. Operation of a thermal ink jet printer is described in, for example, U.S. Pat. No. 4,849,774.

The ink jet printhead may be incorporated into either a carriage type printer or a page width type printer. The carriage type printer typically has a relatively small printhead containing the ink channels and nozzles. The printhead is usually sealingly attached to a disposable ink supply cartridge and the combined printhead and cartridge assembly is attached to a carriage which is reciprocated to print one swath of information (equal to the length of a column of nozzles) at a time on a stationary recording medium, such as paper or a transparency. After the swath is printed, the paper is stepped a distance equal to the height of the printed swath or a portion thereof so that the next printed swath is overlapping or contiguous therewith. The procedure is repeated until the entire page is printed. In contrast, the pagewidth printer includes a stationary printhead having a length sufficient to print across either the entire width or length of the recording medium. The recording medium is continually moved passed the pagewidth printhead in a direction normal to the length of the printhead and at a constant or varying speed during the printing process. A pagewidth ink jet printer is described in U.S. Pat. No. 5,192,959.

It has been recognized that there is a need to maintain the ink ejecting nozzles of an ink jet printhead, for example, by periodically cleaning the orifices when the printhead is in use, and/or by capping the printhead when the printer is out of use or is idle for extended periods of time. The capping of the printhead is intended to prevent the ink in the printhead from drying out. There is also a need to prime a printhead before use, to insure that the printhead channels are completely filled with ink and contain no contaminants or air bubbles and also periodically to maintain proper functioning of the orifices. Maintenance and/or priming stations for the printheads of various types of ink jet printers are described in, for example, U.S. Pat. Nos. 4,855,764, 4,853,717 and 4,746,938. Removal of gas from the ink reservoir of a printhead during printing is described in U.S. Pat. No. 4,679,059.

It has been found that to properly maintain an ink jet printhead two separate operations must be performed. A conditioning member is typically used to maintain proper condition or operation of the printhead nozzles by priming the nozzles or by vacuuming the face of the printhead to remove any contaminants or ink which may have collected thereon. The second operation is to cap the printhead if the printhead nozzles will be exposed to air for extended periods of time to thereby prevent the ink contained in the nozzles from drying out. To prevent drying, printheads are usually covered with a cap which forms a substantially airtight seal with the face of the printhead. While it is possible to combine the functions of conditioning and capping, it has been found that separate mechanisms for conditioning the printhead front face and for capping the printhead nozzles in a pagewidth printhead are advantageous.

Various methods and apparatus for maintaining the condition of ink jet printheads and for capping ink jet printheads are illustrated and described in the following disclosures which may be relevant to certain aspects of the present invention.

In U.S. Pat. No. 5,206,666 to Watanabe et al., an ink jet recording apparatus having a full-line type recording head rotatably supported between a recording position and a non-recording position is described. A cleaning member contacts the recording head during rotation of the recording head to remove deposited ink or foreign matter. In the non-recording position, the printhead is capped.

U.S. Pat. No. 5,257,044 to Carlotta et al. describes a cap actuation mechanism for use in a maintenance station for an ink jet printhead in a scanning type ink jet printer. A cap located on a cap carriage in an ink jet printer maintenance station provides the functions of printhead nozzle capping, priming, cleaning, refreshing, as well as waste ink management.

U.S. Pat. No. 5,367,326 to Pond et al. describes a pagewidth ink jet printer having a movable cleaning/priming station adapted for movement parallel to and along an array of printhead nozzles. The cleaning and priming station is slidingly moved along a ledge surface so that the cleaning and priming station is maintained a fixed distance from the face of the printhead.

U.S. Pat. No. 5,534,897 filed on Jul. 1, 1993, having the title "Ink Jet Maintenance Subsystem" assigned to Xerox Corporation, discloses an ink jet maintenance subsystem for a full width array thermal ink jet printer. The system includes a translatable maintenance station carriage assembly translating across the width of the full width array printbar and also includes an articulating cap assembly for capping the printbar nozzles when the translatable maintenance station carriage assembly is at a home position outside the edge of the printbar. When the cap assembly moves away from the printbar, a free space area is provided that allows unrestricted translation of the maintenance station carriage assembly.

SUMMARY OF THE INVENTION

In accordance with one aspect of the present invention, there is provided a maintenance apparatus for maintaining an ink jet printhead. The maintenance apparatus includes a maintenance station having a first member, a translation apparatus connected to the maintenance station in which the translation apparatus generates a translation force to translate the maintenance station along a path, and a displacement apparatus connected to the translation apparatus and operatively coupled to the first member for displacing the first member with respect to the translation apparatus and into proximity with the ink jet printhead for performing a maintenance function.

In accordance with another aspect of the present invention, there is provided an ink jet printer having an ink jet printhead and a maintenance station having a first member wherein the maintenance station maintains the operation of the ink jet printhead. Also included is a translation apparatus connected to the maintenance station in which the translation apparatus generates a translation force to translate the maintenance station along a path to a position proximate to the ink jet printhead. A displacement apparatus is connected to the translation apparatus and operatively coupled to the first member in which the displacement apparatus displaces the first member with respect to the translation apparatus and into proximity with the ink jet printhead for performing a maintenance function.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
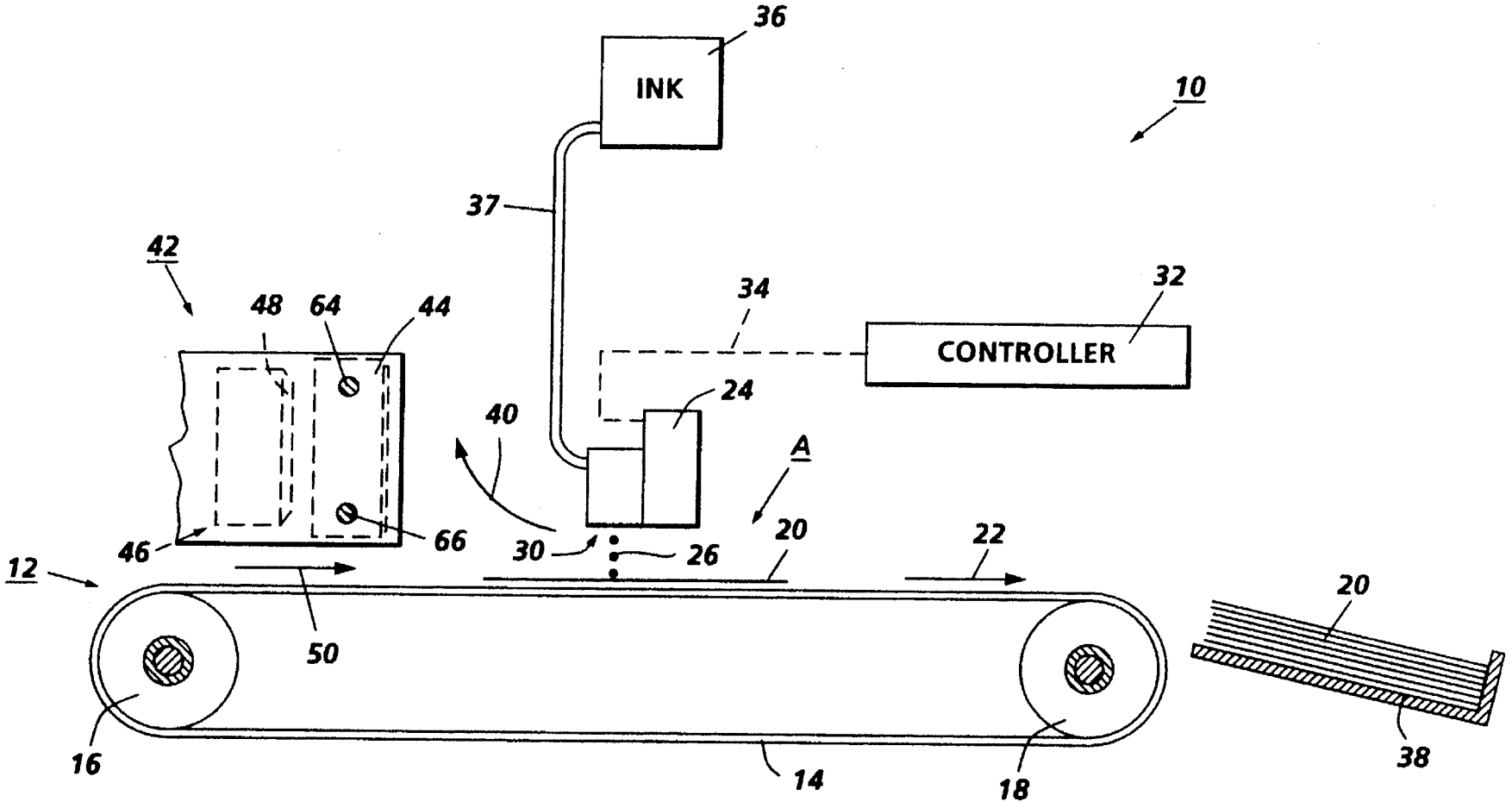
FIG. 1 is a schematic elevational view of an ink jet printer incorporating a maintenance apparatus for maintaining an ink jet printhead.

FIG. 1 illustrates a schematic elevational view of a ink jet printer 10. The ink jet printer 10 employs a transport belt mechanism 12 with belt 14 mounted around rollers 16 and 18, one of which is driven by a motor (not shown). The belt 14 moves a recording medium 20, such as a sheet of paper or a transparency, in the direction of an arrow 22 when placed thereon from a typical cassette or paper supply by a sheet feeder, neither of which is shown. Moreover, the recording medium 20 moves through a printing zone generally referred to by reference letter A. By moving through the printing zone A, the recording medium 20 is printed by a full width printhead 24 which ejects a plurality of ink droplets 26 onto the recording medium 20 as it passes through the printing zone A.

The full width printhead 24 includes a plurality of ink ejecting orifices or nozzles arranged along a front face 30 of the ink jet printhead 24. The face is substantially planar and surrounds the ink ejecting orifices. To print information upon the recording medium 20, a controller 32 coupled to the printhead 24 through a ribbon cable 34, controls selective ejection of ink from each of the ink ejecting orifices. The controller 32 controls the energy pulses typically produced by the heaters (not shown) each located in a respective one of the channels (also not shown), by individually addressing each heater with current pulses. As vapor bubbles grow in any one of the channels due to the heating of the heaters, ink bulges from the ink ejecting orifices until the current pulse has stopped and the bubble begins to collapse. At this stage, the ink within the channel retracts towards the collapsing bubble and separates from the bulging ink, to form a droplet moving in a direction away from the orifice and towards the recording medium. The channel is then refilled by capillary action which in turn receives ink from the ink supply 36. This process repeats until the desired information is printed. After printing, the recording medium 20 leaves the printing zone A and is transported by the belt 14 to an exit tray 38 where the printed sheets are stacked.

While FIG. 1 illustrates a single full width or pagewidth printhead 24, an ink jet printer can include one or more pagewidth printheads 24 for printing black only, highlight color, or full color. In the case of full color printing, an ink jet printer could include four of the ink jet printheads so that one of the ink jet printheads deposits black ink upon the recording medium 20 while the other three ink jet printheads deposit cyan, magenta, and yellow inks for full color printing. The present invention is equally applicable to any number of ink jet pagewidth printheads, but for ease of illustration the present invention will be described with respect to a single pagewidth printhead.

On occasion, either during printing or after printing has been completed, the full width printhead 24 must be serviced or maintained by a maintenance station which provides maintenance functions including priming of the ink jet nozzles, wiping of the front face and capping of the nozzles. The maintenance operation begins by moving the printhead 24 in the direction of the arrow 40 away from the belt 14 to an aligned position with a maintenance station 42. A suitable maintenance station for a page width printhead is described in U.S. Pat. No. 5,534,897 to Anderson et al., entitled "Ink Jet Maintenance Subsystem", assigned to Xerox Corporation, the relevant portions of which are incorporated herein by reference. The maintenance station 42 includes a conditioning member 44 for priming the nozzles of the printhead 24 and/or removing ink or debris which collects upon the front face 30 of the printhead 24. The conditioning apparatus moves across the front face of the printhead 24 and applies suction thereto through the application of a vacuum. In addition to the conditioning member 44, a capping member 46 includes a capping element 48 which contacts the front face 30 of the printhead 24 making a seal therewith, to prevent the ink contained in the nozzles from drying out to thereby prevent clogging of the individual printhead nozzles.

At the completion of a printing operation, or when necessary, the printhead 24, which is supported by a mechanical support to allow the printhead to move in the direction of the arrow 40, is positioned in a maintenance position located in front of the maintenance station 42. When the printhead is aligned therewith, the maintenance station 42 is moved towards the printhead 24 in the direction of an arrow 50 until the conditioning member 44 is sufficiently close to the front face of the printhead 24 for proper priming of the nozzles and/or cleaning of the front face.

Figure 2:
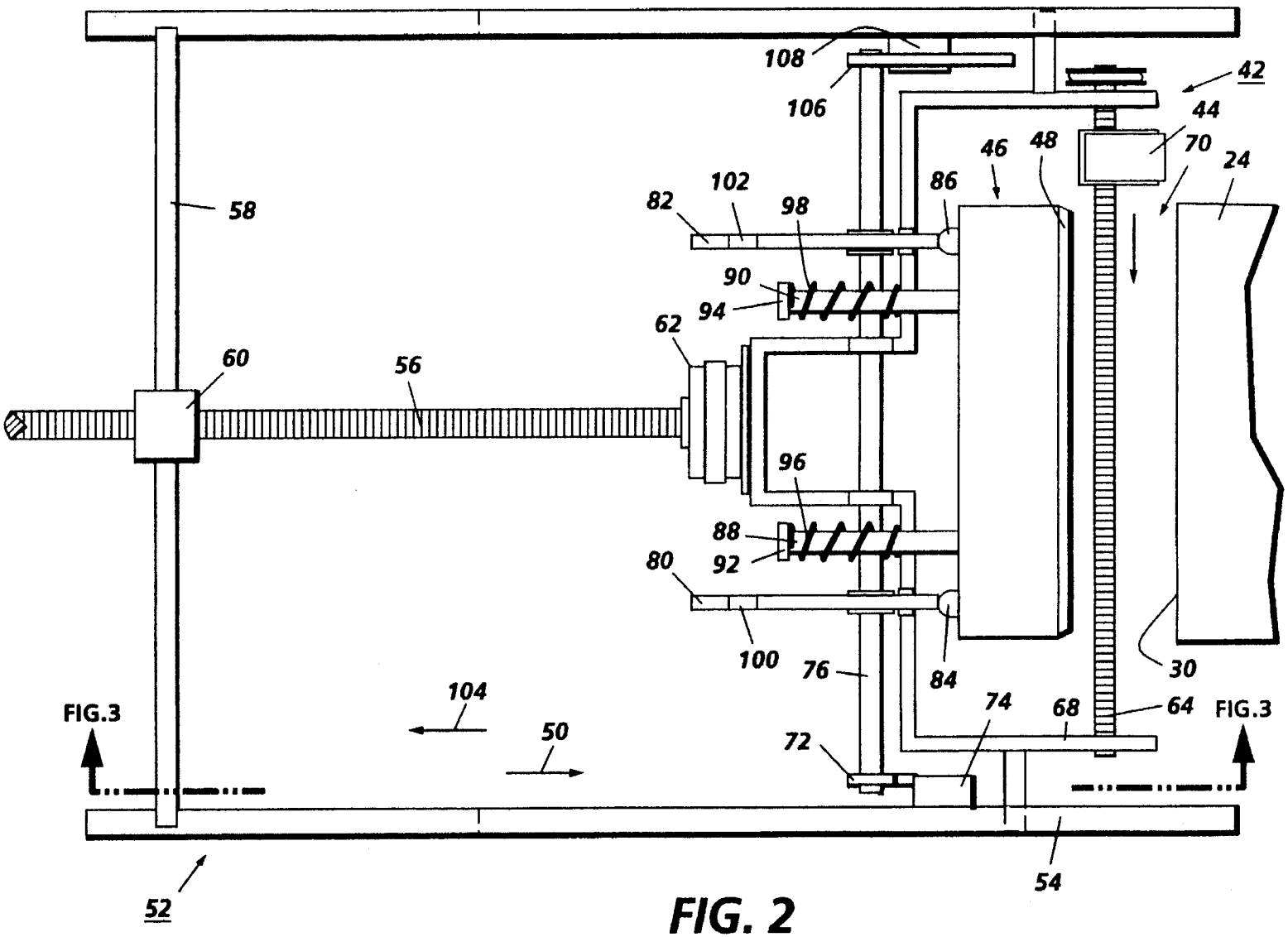
FIG. 2 is a plan view of a maintenance apparatus including the maintenance station of FIG. 1.
Figure 3:
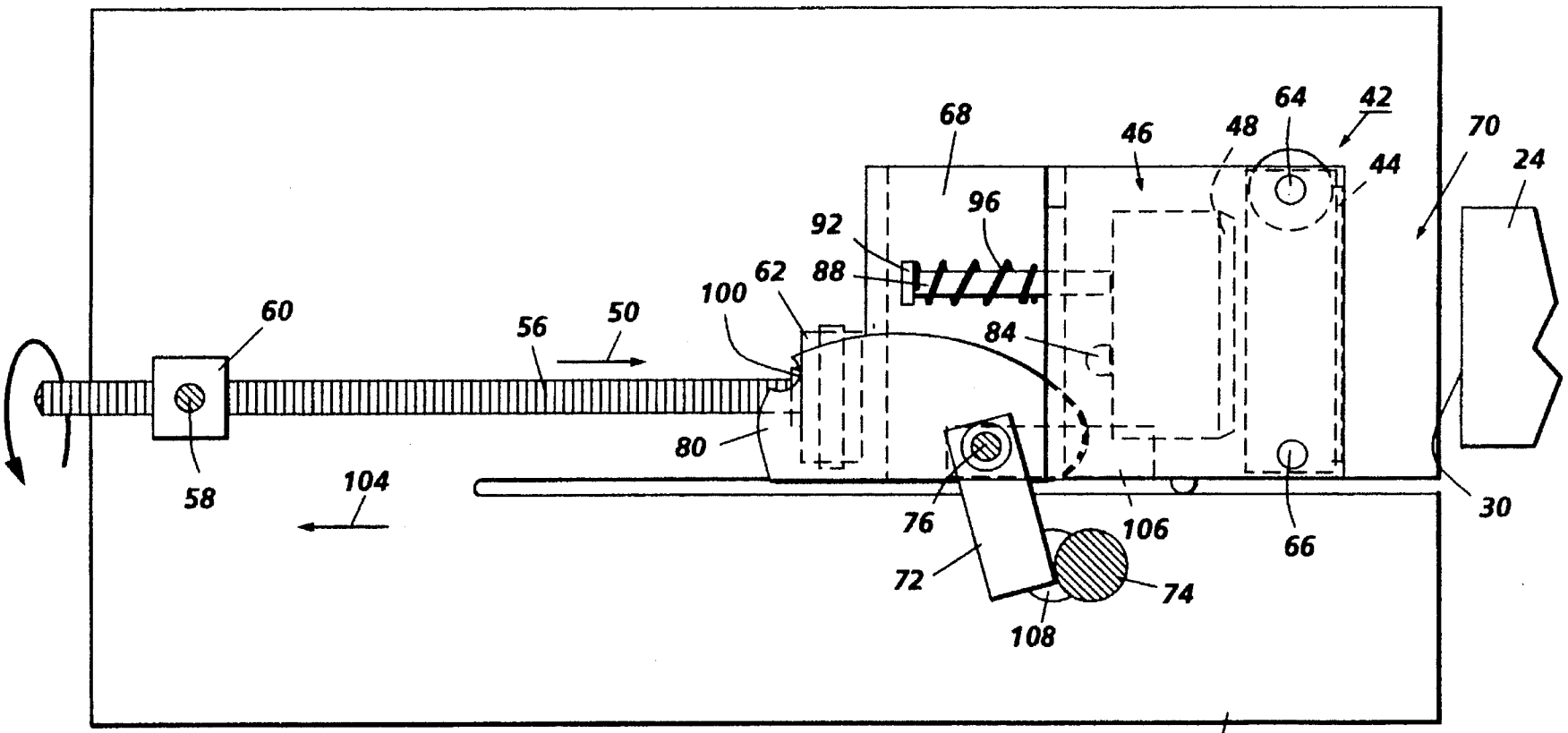
FIG. 3 is a sectional elevational view of the maintenance apparatus of FIG. 2 having the maintenance station in a first position.
Figure 4:
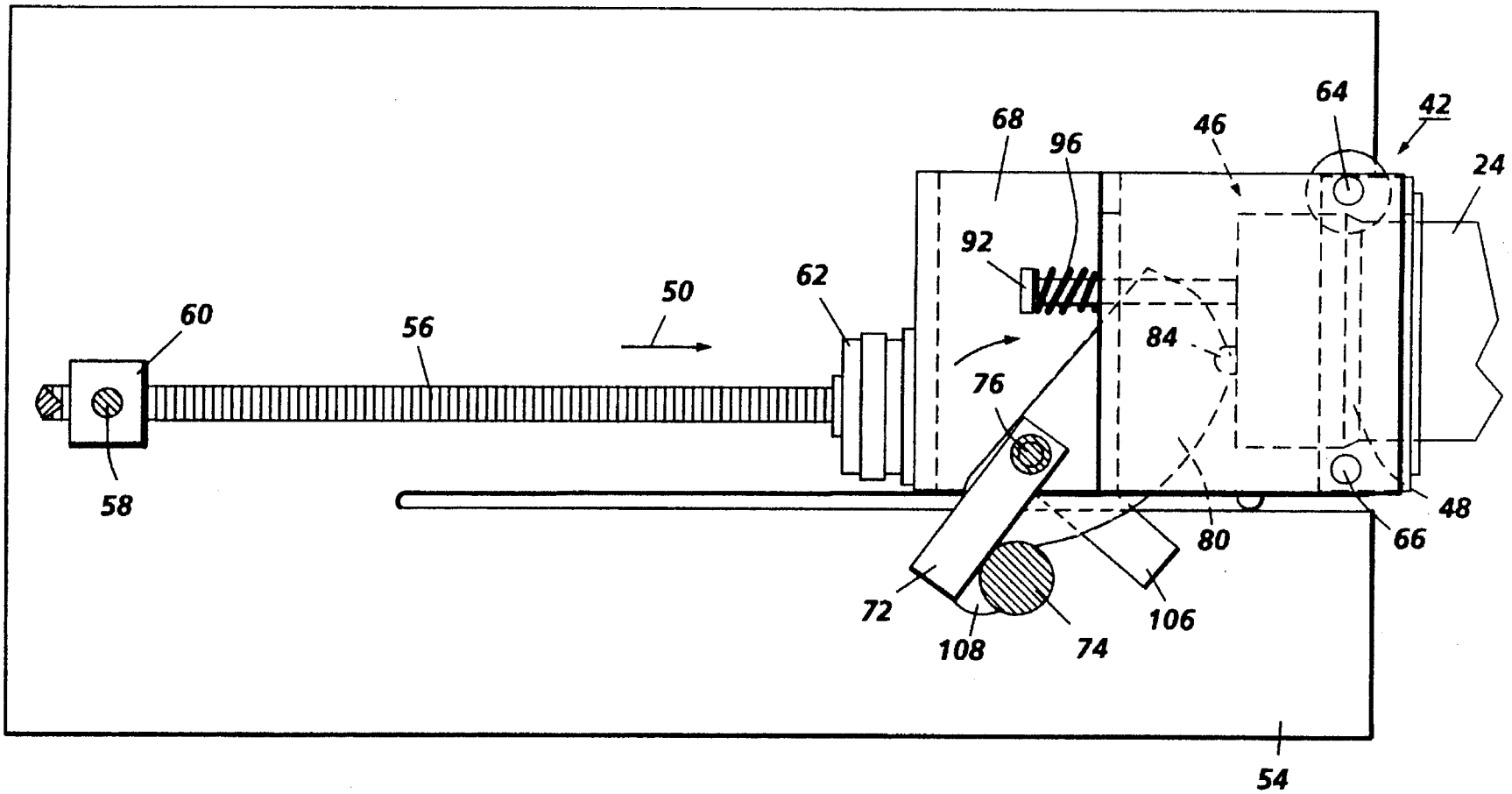
FIG. 4 is a sectional elevational view of the maintenance apparatus of FIG. 2 having the maintenance station in a second position.

The maintenance station 42 is moved in the direction of arrow 50 by a maintenance apparatus 52 further illustrated in FIGS. 2, 3 and 4.

As illustrated in FIG. 2, the maintenance apparatus 52 includes a frame 54 slidably supporting the maintenance station 42 for movement in direction of the arrow 50. The maintenance station 42 is connected to a lead screw 56 supported by a rod 58 which supports a nut 60 through which the lead screw 56 turns. The rotation of the lead screw 56 is controlled by a motor 62 attached to the maintenance station 42 and coupled to the lead screw 56. The motor 62 is controlled by a controller located in the printer 10 as is known by those skilled in the art.

To begin a maintenance operation, the motor 62 rotates the lead screw 56 to move the maintenance station 42 in the direction of the arrow 50 towards the front face 30 of the printhead 24. The maintenance station 42 is moved to a position proximate to the front face 24 so that the conditioning member 44 is sufficiently close to satisfactorily complete a priming and/or cleaning operation thereof. The conditioning member 44 is supported by a first rod 64 and a second rod 66 (see FIG. 1) which enables the conditioning member 44 to traverse across the front face of the printhead 24. The rods 64 and 66 are supported by a frame 68 of the maintenance station 42. The conditioning member 44 moves through a space 70 and across the front face of the printhead 24 under control of a moving mechanism such as a lead screw or pulley/belt system controlled by the printer controller. Once the priming/cleaning operation is complete, the conditioning member 44 exits the space 70 proximate to the front face of the printhead 24. After completion, the printbar 24 either moves back to the print zone A for further printing or remains in the maintenance location for a capping operation.

In order to minimize cost and maintenance apparatus complexity, it is desirable to use the forces generated by the translation apparatus, which includes the lead screw 56 and the motor 62, to extend the cap member 46 into the space 70 for contacting the front face 30 of the printhead 24 and also to retract the cap member 46 once a capping operation is complete. As the motor 62 moves the maintenance assembly 42 in the direction of the arrow 50 via the lead screw 56, an actuator lever 72 in confronting relation with a projecting member 74, contacts the projecting member 74 attached to the frame 54 as illustrated in FIG. 3. The actuating lever 72 is attached to a rotatable rod 76 which is supported by the frame 68 of the maintenance station 42. The rod 76 rotates within the frame 62 and is attached to a first cam 80 and a second cam 82. As the rod 76 rotates due to contact of the actuating lever 72 with the pin 74, the first cam 80 and the second cam 82 respectively contact a first pin 84 and a second pin 86 attached to the capping member 46. The pressure of the cams against the pins move the capping member 46, which is slidably supported by the frame 68 of the maintenance station 42, towards the printbar 24.

To prevent the capping member 46 from moving irregularly under the forward application of force applied by the first cam 80 and the second cam 82, the capping member 46 has attached thereto a first rod 88 and a second rod 90 both of which extend through the frame 68. The first rod 88 and the second rod 90 each respectively terminate in a first end cap 92 and a second end cap 94 for respectively holding a resilient member or first spring 96 and second spring 98. The first spring 96 and the second spring 98 are captivated within the respective end caps and the frame 68 to retard the forward motion of the capping member 46 under the force applied by the first cam 80 and the second cam 82.

As illustrated in FIG. 4, once the actuating lever 72 passes the pin 74, the first cam 80 and the second cam 82 continue to rotate until a first cam detent 100 and a second cam detent 102 are positioned against the pins 84 and 86. At this location, the capping member 46 is positioned as far forward as possible within the maintenance station 42. Further movement of the capping member 46 in the direction of arrow 50, if necessary, is provided by the motor 62 and the lead screw 56 until the capping element 48 is sufficiently compressed against the front face of the printhead 24 to provide an airtight seal or cap for preventing the ink from drying within the nozzles.

Once a capping operation has been completed, the motor 62 reverses the rotation of the lead screw 56 such that the maintenance station 42 moves in the direction of an arrow 104 (see FIG. 2) thereby increasing the distance between the printhead 24 and the capping member 46. As the maintenance station 42 continues to move in the direction of the arrow 104, a second actuating lever 106 connected to the rod 76 contacts a second pin 108 attached to the frame 54 at a side opposite to the pin 74. As the actuating lever 106 contacts the pin 108, the rod 76 rotates in a direction opposite to that previously described for the capping motion and consequently, the cams 80 and 82 are rotated from the detent position. As the cams 80 and 82 continue to rotate from the detent position, the previously compressed first spring 96 and second spring 98 provide a counteracting force against the frame 68 of the maintenance station 42 for pulling the capping member 46 away from the printhead 24. Once the cams 80 and 82 return to the original positions, the conditioning member 44 can again traverse across the rods 64 and 66 to begin another priming/cleaning operation if necessary.

In recapitulation, there has been described a maintenance apparatus for maintaining an ink jet printhead. The maintenance apparatus includes a maintenance station connected to a translation apparatus for translating the maintenance station along a path towards an ink jet printhead positioned for a capping/maintenance operation. A displacement apparatus, which includes the actuating levers 72 and 76 and the cams 80 and 82, is coupled to the translation apparatus and is operatively connected to the maintenance station such that the displacement apparatus displaces the maintenance station with respect to the translation apparatus when the actuating levers contact the pins 74 and 108.

It is, therefore apparent, that there has been provided in accordance with the present invention, a maintenance apparatus for maintaining an ink jet printhead that fully satisfies the aims and advantages hereinbefore set forth. While this invention has been described in conjunction with a specific embodiment thereof, it is evident that many alternatives, modifications, and variations will be apparent to those skilled in the art. For instance, other translation apparatus are also possible and need not necessarily include a motor driving a lead screw. For instance, rack and pinion drive mechanisms as well as pulley or chain driven mechanisms are also possible to translate the maintenance station along the predetermined path. Likewise, the displacement apparatus which includes the actuating levers and cams can be accomplished by other mechanical displacing mechanisms such as solenoids. In addition, it is also possible to use the present invention with any printhead which dispenses liquid ink or other media of a volatile nature and is not limited to thermal ink jet devices but includes all liquid ink printhead devices including piezoelectric devices and phase change ink devices. Accordingly, it is intended to embrace all such alternatives, modifications and variations that fall within the spirit and broad scope of the appended claims.

What is claimed is:

1. A maintenance apparatus for maintaining an ink jet printhead, comprising:

a maintenance station having a capping member;

a translation apparatus connected to said maintenance station, said translation apparatus generating a translation force to translate said maintenance station along a path, including a lead screw and a motor coupled to said lead screw, said motor moving said lead screw to thereby translate said maintenance station along the path;

a displacement apparatus connected to said translation apparatus and operatively coupled to said capping member, displacing said capping member with respect to said translation apparatus and into proximity with the ink jet printhead for performing a maintenance function, including an actuating mechanism converting said translation force to a displacement force displacing said capping member with respect to said translation apparatus, wherein said actuating mechanism includes an actuating lever in confronting relation with a projecting member, said actuating lever contacting said projecting member during translation of said translation apparatus to cause said capping member to be displaced with respect to said translation apparatus.

2. The apparatus of claim 1, wherein said maintenance station comprises a conditioning member conditioning the printhead.

3. The apparatus of claim 2, wherein said capping member is locatable in a first position, the first position defining a space between said capping member and the printhead sufficient to contain said conditioning member.

4. The apparatus of claim 3, wherein said actuating member comprises a camming member, said camming member rotated about an axis by said actuating lever and contacting said capping member to move said capping member into the defined space.

5. The apparatus of claim 4, wherein said capping member contacts the printhead in a second position.

6. The apparatus of claim 5, wherein said displacement apparatus includes a resilient member in contact with said capping member, said resilient member counteracting the rotational movement of said camming member.

7. An ink jet printer, comprising:

an ink jet printhead;

a maintenance station having a capping member, said maintenance station maintaining the operation of said ink jet printhead;

a translation apparatus connected to said maintenance station, said translation apparatus generating a translation force to translate said maintenance station along a path to a position proximate to said ink jet printhead, including a lead screw and a motor coupled to said lead screw, said motor moving said lead screw to thereby translate said maintenance station along the path; and a displacement apparatus connected to said translation apparatus and operatively coupled to said capping member, said displacement apparatus displacing said capping member with respect to said translation apparatus and into proximity with said ink jet printhead for performing a maintenance function, including an actuating mechanism converting said translation force to a displacement force displacing said capping member with respect to said translation apparatus wherein said actuating mechanism includes an actuating lever in confronting relation with a projecting member, said actuating lever contacting said projecting member during translation of said translation apparatus to cause said capping member to be displaced with respect to said translation apparatus.

8. The printer of claim 7, wherein said maintenance station comprises a conditioning member conditioning said printhead.

9. The printer of claim 8, wherein said capping member is locatable in a first position, the first position defining a space between said capping member and said printhead sufficient to contain said conditioning member.

10. The printer of claim 9, wherein said actuating member comprises a camming member, said camming member rotated about an axis by said actuating lever and contacting said capping member to move said capping member into the defined space.

11. The printer of claim 10, wherein said capping member contacts said printhead in a second position.

12. The printer of claim 11, wherein said displacement apparatus includes a resilient member in contact with said capping member, said resilient member counteracting the rotational movement of said camming member.

* * * * *